US006156465A

United States Patent [19]

Cao et al.

[11] Patent Number: 6,156,465

[45] Date of Patent: Dec. 5, 2000

[54] CROSSTALK CORRECTION

[75] Inventors: Fred Fang Cao, Richmond, Canada; Horst W. Schaaf, Bellingham, Wash.; Susan Shuping Zhang, Richmond, Canada

[73] Assignee: Cymbolic Sciences Inc., Richmond, Colombia

[21] Appl. No.: 09/289,730

[22] Filed: Apr. 12, 1999

[51] Int. Cl.[7] ..... G03C 5/02

[52] U.S. Cl. ..... 430/30; 430/359; 430/362

[58] Field of Search ..... 430/30, 359, 362

[56] References Cited

PUBLICATIONS

The Theory of the Photographic Process, Fourth Edition, T.H. James, pp. 532–534, 1977.

*Primary Examiner*—Thorl Chea

*Attorney, Agent, or Firm*—Elbie R. de Kock

[57] ABSTRACT

A method of crosstalk correction comprises producing a calibration image having different printed image densities in grayscale, measuring the printed image densities at the different light exposure values to obtain a correlation of printed density in grayscale as a function of light exposure value over a range of light exposure values, obtaining experimental analytical density values for a selected light exposure value within the range of light exposure values and using the correlation of printed density as a function of light exposure value and the experimental analytical density values to correct for crosstalk.

10 Claims, 3 Drawing Sheets

CROSSTALK CORRECTION

FIELD OF THE INVENTION

This invention relates to a method of correcting crosstalk effect when forming an image on an image recording medium.

BACKGROUND OF THE INVENTION

Color photographic material usually has three light sensitive layers of emulsion. Each layer is specifically sensitive to either red, green or blue light. When the material is exposed to light, each layer absorbs the light it is sensitive to, producing a dye of a color complementary to the color being absorbed, i.e. cyan, magenta and yellow, respectively. Ideally, each dye absorbs only one color light, i.e. cyan dye absorbs only red light, magenta dye absorbs only green light and yellow dye absorbs only blue light. Thus, each dye absorbs its complimentary light only and permits the other two primary colors to be transmitted freely. However, in practice, each dye absorbs small amounts of the non-complementary light as well, which has an effect on the density of the resulting image. This effect is known as crosstalk and it limits the ability of the image registering material to accurately simulate real life colors.

The conventional method used to correct the crosstalk effect is the so-called iteration method. It is conducted on a trial and error basis which involves using various amounts of light to expose the photographic material until an acceptable image is obtained. This method is very time consuming and results in the wastage of photographic material.

It is accordingly an object of the present invention to provide a method of crosstalk correction without the above mentioned disadvantages.

SUMMARY OF THE INVENTION

According to the invention there is provided a method of correcting crosstalk in a colour printing process using a colour photographic medium having a plurality of light sensitive dyes, each dye having an associated complimentary colour light associated therewith and at least one non-complimentary colour light associated therewith, each dye primarily absorbing the complimentary light associated therewith, comprising the steps of producing a calibration image having different printed image densities in grayscale by exposing the photographic medium to light comprising said complimentary and non-complimentary colours, in a range of different light exposure values; measuring the printed image densities at the different light exposure values to obtain a correlation of printed density in grayscale as a function of light exposure value over a range of light exposure values for each of the complimentary and non-complimentary colours; producing an analytical density test image for each of said complimentary and non-complimentary colours by exposing the photographic medium successively to light of each of said complimentary and non-complimentary colours for a selected light exposure value within said range of light exposure values; measuring the analytical density contributed by each of said complimentary and non-complimentary colours, respectively, from said test images; and using said correlation of printed density as a function of light exposure value and said measured analytical density to correct for crosstalk. In one particular embodiment, the crosstalk effect is corrected by obtaining corrected analytical density values for said complimentary and said non-complimentary colors from said correlation of printed density as a function of light exposure value and said measured analytical density and producing modified printed density values by which crosstalk is corrected.

Also according to the invention there is provided a method of correcting crosstalk in a colour printing process using a colour photographic medium having a plurality of light sensitive dyes, each dye having an associated complimentary colour light associated therewith and at least one non-complimentary colour light associated therewith, each dye primarily absorbing the complimentary light associated therewith, comprising the steps of producing a calibration image having different printed image densities in grayscale by exposing the photographic medium to light comprising said complimentary and non-complimentary colours, in a range of different light exposure values; measuring the printed image densities at the different light exposure values to obtain a correlation of printed density in grayscale as a function of light exposure value over a range of light exposure values for each of the complimentary and non-complimentary colours; producing an analytical density test image for each of said complimentary and non-complimentary colours by exposing the photographic medium successively to light of each of said complimentary and non-complimentary colours for a range of light exposure values; measuring the analytical density contributed by each of said complimentary and non-complimentary colours, respectively, from said test images to obtain a correlation of analytical density as a function of light exposure value over a range of light exposure values for each of said complimentary and non-complimentary colors; and using said correlations of printed density as a function of light exposure value and said correlation of analytical density as a function of light exposure value to correct for crosstalk.

According to one aspect of the invention, the complimentary and non-complimentary colors may comprise the primary colors red, green and blue and according to another aspect, they may comprise cyan, magenta, yellow and black.

Also according to the invention there is provided a method of recording an image on an image recording medium, characterized in that the medium is exposed to light having an exposure value which is adjusted responsive to the modified printed density values.

Further objects and advantages of the invention will become apparent from the description of preferred embodiments of the invention below.

BRIEF DESCRIPTION OF THE DRAWINGS

The invention will now be described, by way of an example, with reference to the accompanying drawings, in which.

DETAILED DESCRIPTION OF PREFERRED EMBODIMENT

Figure 1:
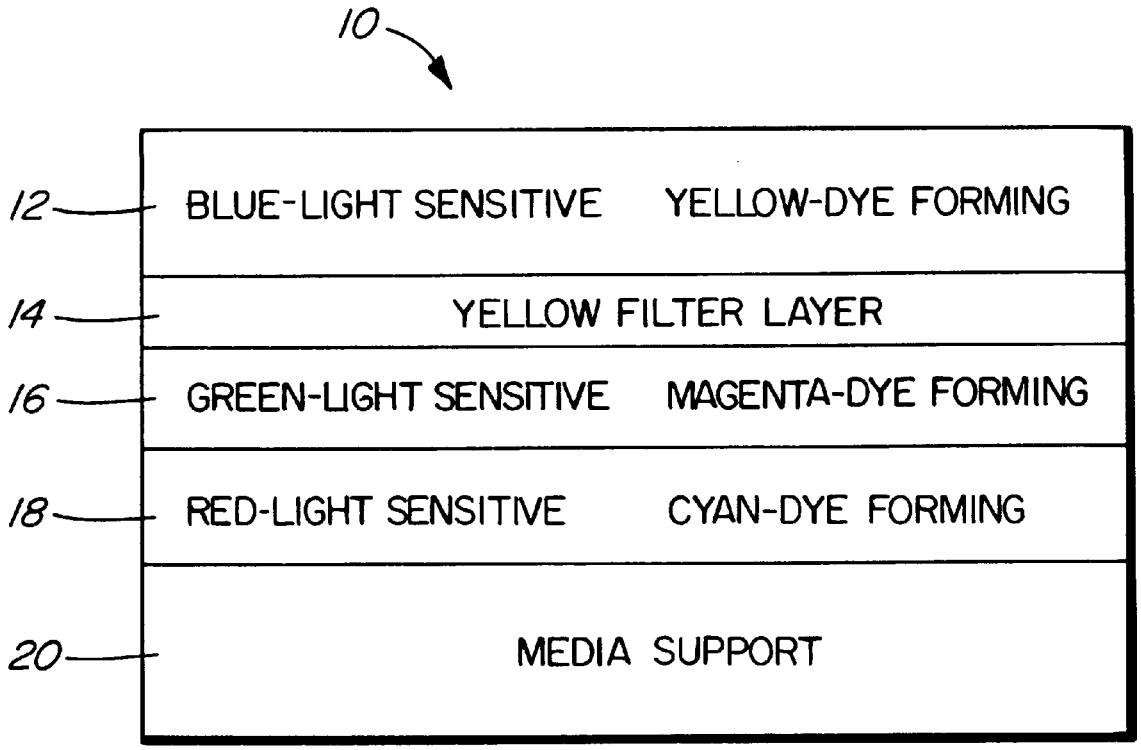
FIG. 1 PRIOR ART
FIG. 1 is a schematical illustration of a conventional photographic material medium showing the different light sensitive layers.

FIG. 1 shows a simplified cross-section of a conventional color photographic medium 10. The medium 10 has a blue light sensitive layer 12, a yellow filter layer 14 for blocking the blue light, a green light sensitive layer 16 and a red light sensitive layer 18, all coated on a support layer 20. When the medium 10 is exposed to light and chemically processed, yellow, magenta and cyan dyes are formed by the layers 12, 16 and 18, respectively.

To form an image, the medium 10 is exposed to light with a certain light exposure value.

The light exposure values for red, green and blue light are given by the following equations:

$$R_{exp}=k_r\Sigma\lambda S(\lambda)T(\lambda)r(\lambda)$$

$$G_{exp}=k_g\Sigma\lambda S(\lambda)T(\lambda)g(\lambda)$$

$$B_{exp}=k_b\Sigma\lambda S(\lambda)T(\lambda)b(\lambda) \quad (1)$$

where $R_{exp}$, $G_{exp}$ and $B_{exp}$ are the light exposure values for red, green, and blue light; $S(\lambda)$ is the spectral power distribution of the printer light source; $T(\lambda)$ is the spectral transmittance of the medium; $r(\lambda)$, $g(\lambda)$, and $b(\lambda)$ are the red, green, and blue spectral sensitivities of the medium; and $k_r$, $k_g$, and $k_b$ are normalizing factors. These normalizing factors usually are determined such that $R_{exp}$, $G_{exp,}$ and $B_{exp}$= 1.0 for a theoretical 100% transmission negative.

The printing density values of the red, green and blue light on the exposed material 10 are, per definition, given by:

$$PD_r=-\log_{10}(R_{exp})$$

$$PD_g=-\log_{10}(G_{exp})$$

$$PD_b=-\log_{10}(B_{exp}) \quad (2)$$

where $PD_r$, $PD_g$, $PD_b$ are red, green, and blue printing density values. These are the parameters which represent the color characteristics of the printing medium.

In carrying out the crosstalk correction method, the medium 10 is exposed with white light by means of a combination of red, green and blue light, in a stepwise fashion with linearly increasing light exposure values, for example, at 32 different values, to form a strip with printed grayscale densities, referred to as a "step tablet". The increases in the successive light exposure values are in equal steps.

The step tablet is used to obtain a correlation between the printed grayscale densities and the known light exposure values. The term "printed grayscale density" refers to the red, green and blue density of a grayscale image measured with a densitometer which introduces no contributing error.

Figure 2:
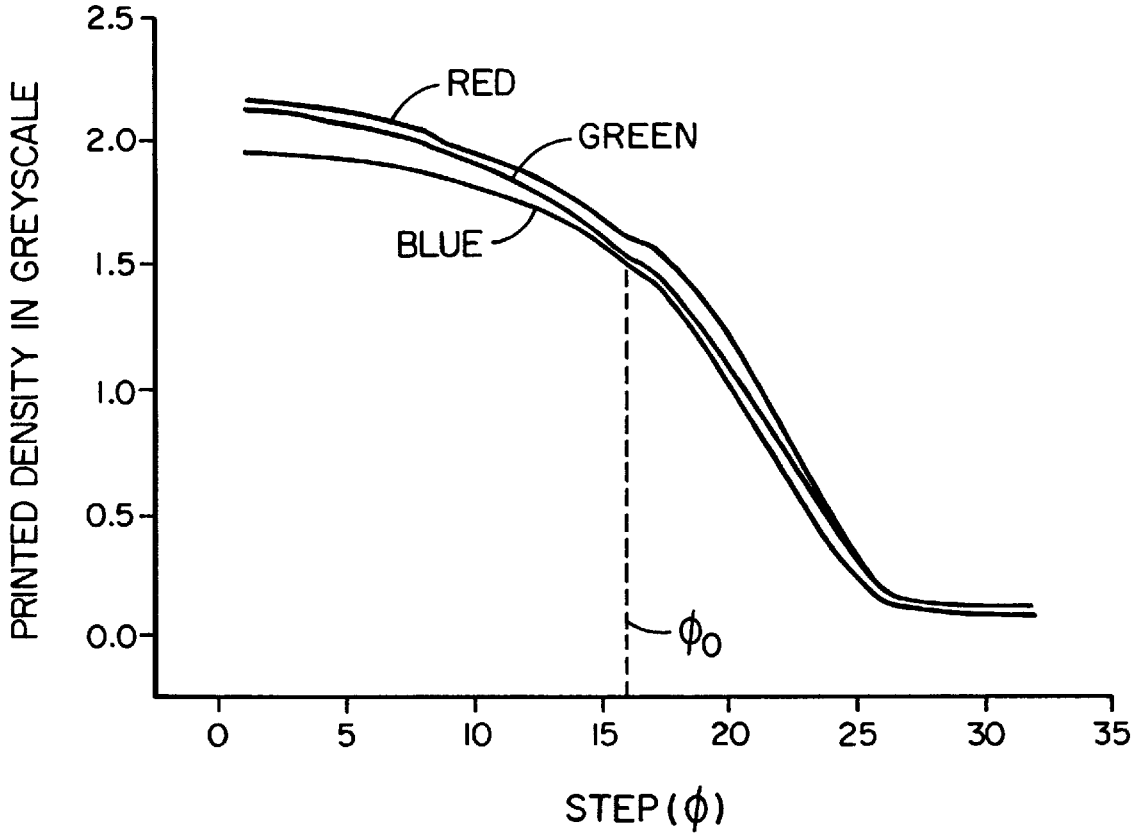
FIG. 2 is a graph showing printed density in grayscale as a function of light exposure value.

The measured printed densities are then plotted against light exposure values to obtain a curve for each of the red, green and blue light, as shown in FIG. 2, each curve representing the printed density as a function of light exposure value ($\emptyset$).

The function is as follows:

$$PD\lambda_k(\emptyset)=\psi(\lambda_k,\emptyset)+\delta\psi(\lambda_{i,j,}\emptyset);\ K\neq i,j; \quad (3)$$

where $PD_{80\ k(\emptyset)}$ is the printed density (either red, green or blue) measured in the grayscale, $\lambda_{i,j,k}$ is the wavelength of light exposure (either red, green, or blue), $\psi(\lambda_{k,}\emptyset)$ is the analytical density contributed only from $\lambda_k$ (without $\lambda_{i,j}$). $\delta\psi(\lambda_{i,j,}\emptyset)$ is the density contributed to $PD_{\lambda k}(\emptyset)$ by the exposure light with $\lambda_{i,j,}$ which is the cross talk effect.

For example if $\lambda_k$ is the red printed grayscale density then $PD_{\lambda k}(\emptyset)$ is the total red density measured, $\psi$ is the portion of this total contributed by the red light exposure and $\delta\psi$ is the portion of this total contributed by green and blue light exposure.

Thus, the printed grayscale density is a combination of the analytical density plus the crosstalk effect.

It has been found that the ratio of the crosstalk effect to the printed density in grayscale is independent of the light exposure value. In view of this, the analytical density at an arbitrary light exposure value (preferably in the middle region of the density curve of FIG. 2) is selected and measured using only red, green and blue light, respectively. This is effected by exposing the photographic medium using only red light with the selected light exposure value to form a test block on the photographic medium from which the analytical density is measured with a densitometer. This procedure is repeated using only green and blue light, respectively, to produce two further test blocks. A further test block is produced using white light with the selected light exposure value. The corresponding printed density value is then measured using this test block.

Using the above measured values and the corresponding printed density values obtained from FIG. 2, $\delta\psi(\lambda_{i,j,}\emptyset)$ is calculated using the following equation:

$$\delta\psi(\lambda_{i,j,}\emptyset)=PD\lambda_k(\emptyset)*[1-\psi(\lambda_k,\emptyset_0)/PD\lambda_k(\emptyset_0)] \quad (4)$$

where $\emptyset_0$ is the selected light exposure value in the middle region of the density curve, shown in FIG. 2.

Then Equation (3) is used to calculate the analytical densities $\psi(\lambda_k,\emptyset)$ for red, green and blue, respectively.

Alternatively, instead of using a selected density $\emptyset_0$, the analytical densities can be measured directly by producing a test block on the photographic medium for each of red, green and blue light only over a range of light exposure values, in order to obtain analytical density as a function of light exposure value. Using the function, these measured values can be extrapolated to provide analytical density values for any required range of light exposure values, e.g. 256 values in order to obtain the desired accuracy. The same applies to the functional relationships of FIG. 2.

Using this alternative method, the crosstalk effect $\delta\psi(\lambda_{i,j,}\emptyset)$ can be calculated directly from Equation (3) and Equation (4) is not required. Although this procedure involves more measurements, it is considered to be somewhat more accurate than the first method where a selected light exposure value ($\emptyset_0$) is used. This is due to the fact that the error contributed by measuring the analytical densities over a range of light exposure values and the uncertainty of the analytical densities contributed by measurement statistical error and the uncertainty of the densitometer are smaller than the uncertainty of the analytical densities obtained by making measurement for a selected density ($\emptyset_0$) and using Equation (3) and Equation (4).

It should be noted that in Equation (3), both analytical density $\psi(\lambda_k,\emptyset)$ and the crosstalk contribution $\delta\psi(\lambda_{i,j,}\emptyset)$ are for the same light exposure value ($\emptyset$) However, in practice, the red, green and blue light ($\lambda=\lambda_i$, $\lambda_j$, $\lambda_k$) could be exposed with different exposure values ($\emptyset_{i,j,k}$) in order to achieve a desired density in grayscale, which very often is a balanced grayscale. These different exposure values produce different crosstalk contributions $\delta\psi(\lambda_{i,j,}\emptyset)$ because they have different light exposure values. Therefore, in Equation (3) in order to keep the printed grayscale density ($PD\lambda_k$) constant with the varying light exposure values, the analytical density $\psi(\lambda_k,\emptyset)$ must be varied. To vary the analytical density, $\psi(\lambda_k,\emptyset+\Delta\emptyset)$ can be obtained as follows:

$$\psi(\lambda k,\emptyset+\Delta\emptyset)=PD\lambda_k(\emptyset)-\Delta\delta\psi(\lambda_{i,j});\quad (5)$$

where $$\Delta\delta\psi(\lambda_{i,j})=\delta\psi(\lambda_{i,j},\emptyset_{i,j})-\delta\psi(\lambda_{i,j,}\emptyset);\quad (6)$$

The terms in Equation (6) are calculated using Equation (4) in the case where a selected light exposure value ($\emptyset_0$) is used or using Equation (7) when measured analytical density values are used:

$$\delta\psi(\lambda_{i,j},\emptyset)=PD\lambda_k(\emptyset)-\psi(\lambda_k,\emptyset) \quad (7)$$

Equation (6) is used to calculate the crosstalk effect contributed by the non-complementary light at the same and different light exposure value as the complementary light, respectively. This value in turn is used to recalculate the analytical density using Equation (5).

Finally, the adjusted light exposure value $\emptyset+\Delta\emptyset$, to correct for the crosstalk effect is calculated as follows:

$$\emptyset+\Delta\emptyset=\psi^{-1}\{\lambda k,[PD_{\lambda k}-\Delta\delta\psi(\lambda_{i,j})]\} \quad (8)$$

It should be noted that after the crosstalk correction, there is a second order crosstalk effect when $\emptyset$ is changed to $\emptyset+\Delta\emptyset$. The correction procedure can, therefore, be repeated. However, in practice, the second order crosstalk effect is of the order of the densitometer margin of error and can be neglected.

Due to the fact that the cyan dye is responsible for a more significant contribution to the crosstalk effect compared to that from yellow and magenta dye, it is important to correct for the effect of red printed grayscale density first.

Figure 3:
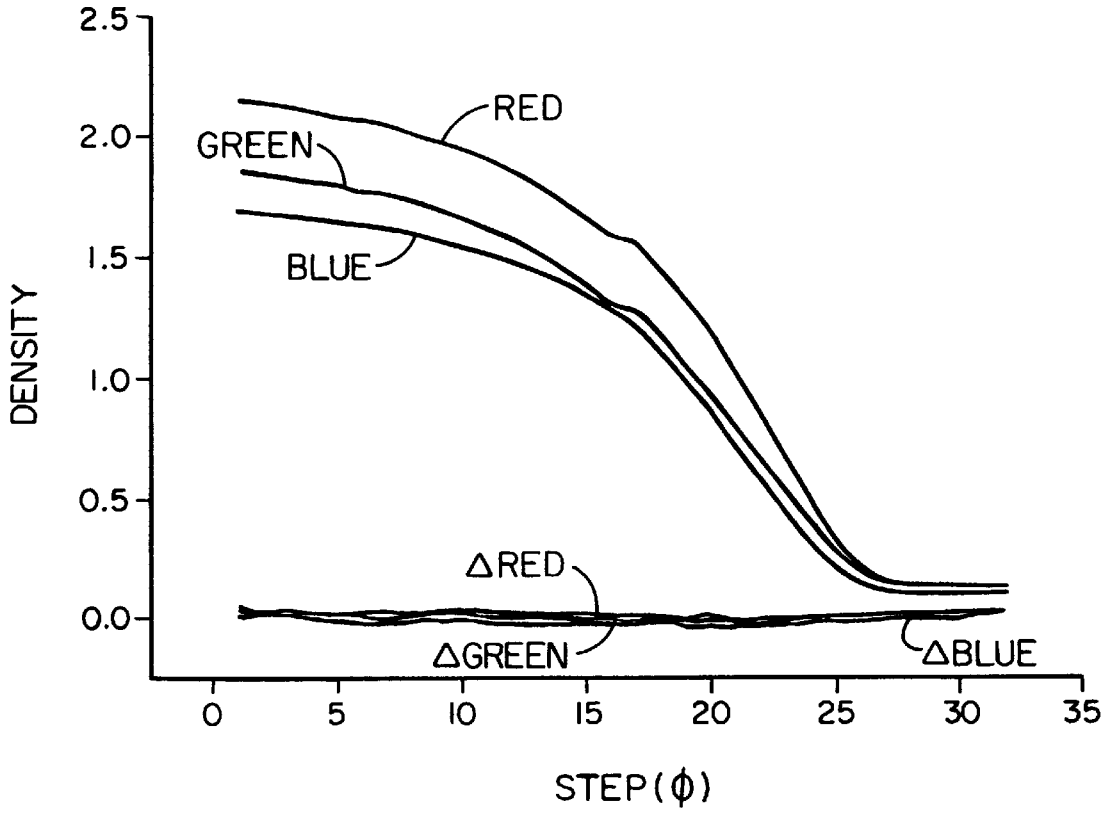
FIG. 3 is a graph showing the agreement of measured analytical density values and the values calculated according to the method of the present invention.

In FIG. 3 the analytical densities contributed only by red (R), green (G) and blue (B) light are shown as a function of light exposure value. $\Delta R$,$\Delta G$ and $\Delta B$ represent the difference between analytical densities which are directly measured and the values calculated using Equations 3 and 4 for red, green and blue light respectively. The graph shows that the measured and calculated values are in agreement with each other, thereby demonstrating the correctness of the method.

It is an advantage of the crosstalk correction method that a single calibration image (the step tablet) and test blocks are printed, which are then used to obtain measured printed image density values which in turn are used to correct the crosstalk effect by means of a linearization method.

While, in the example above, reference has been made to a typical photographic medium having three layers of dye, it will be appreciated that the method according to the invention can also be applied with other photographic media having only two layers on the one hand or having more than three layers on the other hand. For example, if the medium has two layers of dye, the crosstalk correction is effected for each of the two layers of dye and in the case of more than three layers of dye, the crosstalk contribution from the additional layers is added. In other words, the correction is effected for a particular color density in respect of the contribution of all the other dye layers.

While only preferred embodiments of the invention have been described herein in detail, the invention is not limited thereby and modifications can be made within the scope of the attached claims.

What is claimed is:

1. A method of correcting crosstalk in a colour printing process using a colour photographic medium having a plurality of light sensitive dyes, each dye having an associated complimentary colour light associated therewith and at least one non-complimentary colour light associated therewith, each dye primarily absorbing the complimentary light associated therewith, comprising the steps of:

producing a calibration image having different printed image densities in grayscale by exposing the photographic medium to light comprising said complimentary and non-complimentary colours, in a range of different light exposure values;

measuring the printed image densities at the different light exposure values to obtain a correlation of printed density in grayscale as a function of light exposure value over a range of light exposure values for each of the complimentary and non-complimentary colours;

producing an analytical density test image for each of said complimentary and non-complimentary colours by exposing the photographic medium successively to light of each of said complimentary and non-complimentary colours for a selected light exposure value within said range of light exposure values;

measuring the analytical density contributed by each of said complimentary and non-complimentary colours, respectively, from said test images; and using said correlation of printed density as a function of light exposure value and said measured analytical density to correct for crosstalk.

2. The method according to claim 1, wherein the crosstalk effect is corrected by obtaining corrected analytical density values for said complimentary and said non-complimentary colors from said correlation of printed density as a function of light exposure value and said measured analytical density and producing modified printed density values by which crosstalk is corrected.

3. The method according to claim 2 wherein said complimentary and non-complimentary colors comprise the primary colors red, green and blue.

4. The method according to claim 2, wherein said complimentary and non-complimentary colors comprise cyan, magenta, yellow and black.

5. A method of recording an image on a colour photographic medium, characterized in that the medium is exposed to light having an exposure value which is adjusted responsive to the modified printed density values of claim 2.

6. A method of correcting crosstalk in a colour printing process using a colour photographic medium having a plurality of light sensitive dyes, each dye having an associated complimentary colour light associated therewith and at least one non-complimentary colour light associated therewith, each dye primarily absorbing the complimentary light associated therewith, comprising the steps of:

producing a calibration image having different printed image densities in grayscale by exposing the photographic medium to light comprising said complimentary and non-complimentary colours, in a range of different light exposure values;

measuring the printed image densities at the different light exposure values to obtain a correlation of printed density in grayscale as a function of light exposure value over a range of light exposure values for each of the complimentary and non-complimentary colours;

producing an analytical density test image for each of said complimentary and non-complimentary colours by exposing the photographic medium successively to light of each of said complimentary and non-complimentary colours for a range of light exposure values;

measuring the analytical density contributed by each of said complimentary and non-complimentary colours, respectively, from said test images to obtain a correlation of analytical density as a function of light exposure value over a range of light exposure values for each of said complimentary and non-complimentary colors; and using said correlations of printed density as a function of light exposure value and said correlation of analytical density as a function of light exposure value to correct for crosstalk.

7. The method according to claim 6, wherein the crosstalk effect is corrected by obtaining corrected analytical density values for said complimentary and said non-complimentary colors from said correlations of printed density as a function of light exposure value and said correlations of analytical density as a function of light exposure value and producing modified printed density values by which crosstalk is corrected.

8. The method according to claim 7 wherein said complimentary and non-complimentary colors comprise the primary colors red, green and blue.

9. The method according to claim 7, wherein said complimentary and non-complimentary colors comprise cyan, magenta, yellow and black.

10. A method of recording an image on a colour photographic medium, characterized in that the medium is exposed to light having an exposure value which is adjusted responsive to the modified printed density values of claim 7.

* * * * *